United States Patent [19]

Berry et al.

[11] Patent Number: 4,524,821

[45] Date of Patent: Jun. 25, 1985

[54] APPARATUS TO IMPROVE CASTING BAND LIFE

[75] Inventors: Milton E. Berry, Carrollton, Ga.; Mitsuyoshi Shibata, Ichihara, Japan

[73] Assignee: Southwire Company, Carrollton, Ga.

[21] Appl. No.: 461,098

[22] Filed: Jan. 26, 1983

[51] Int. Cl.[3] ..... B22D 11/06

[52] U.S. Cl. ..... 164/482; 164/121; 164/338.1; 164/433

[58] Field of Search ..... 164/482, 433, 434, 481, 164/432, 121, 338.1; 432/214

[56] References Cited

U.S. PATENT DOCUMENTS 3,290,026 12/1966 Alexeff ..... 432/214 X

FOREIGN PATENT DOCUMENTS

| | | | |
|---|---|---|---|
| 47-37822 | 9/1972 | Japan | 164/482 |
| 56-45255 | 4/1981 | Japan | 164/433 |
| 57-19133 | 2/1982 | Japan | 164/433 |
| 2085779A | 5/1982 | United Kingdom | 164/433 |

*Primary Examiner*—Nicholas P. Godici
*Assistant Examiner*—J. Reed Batten, Jr.
*Attorney, Agent, or Firm*—Herbert M. Hanegan

[57] ABSTRACT

Casting band heater for molten metal continuous casting apparatus, wherein a casting band forming one of the mold surfaces is preheated to improve the operational life of the casting band. The apparatus also assures a dry band to avoid steam explosions and gas entrapments. The band heater includes an efficient burner and a band enclosure which can be opened for band changes.

13 Claims, 3 Drawing Figures

APPARATUS TO IMPROVE CASTING BAND LIFE

BACKGROUND ART

The present invention relates to the casting of molten metals, particularly continuous casting apparatus wherein at least one of the mold surfaces is an endless metal band and a method of improving the useful life of the endless band.

Continuous molten metal casting apparatus of the wheel-band type, or alternatively of the twin (or multiple) belt type, wherein an elongated endless band forms one of the mold surfaces, such as by partially enclosing a groove inscribed about the periphery of a rotatable casting wheel are well known and have been overwhelmingly adopted for commercial production of non-ferrous metals in recent decades. With higher-temperature metals such as steel, band life is significantly reduced by heating and erosion effects. Band parting, especially sudden and unexpected band breaking during casting, is or can be calamitous. To avoid this problem bands have either been replaced at regular intervals long before band deterioration or expensive and relatively complex mechanical systems have been adopted to overcome short band life.

The present invention avoids these and other problems and additionally provides a method of drying coolant remaining on the belt from the casting operation.

The apparatus is of a configuration such that it may be used or retrofitted with a great many of the wheel-band and twin-belt casting machines and casting machine configurations of past and present manufacture.

In one typical system for continuously casting a molten substance, an endless flexible metal band is guided about one or more generally fixed position idler or tension band wheels and a portion of the peripheral groove of a casting wheel rotatable about a fixed axis. For the purpose of example but not limitation, the casting of molten metals such as copper, steel, and aluminum, or alloys thereof, will be discussed. The molten metal to be cast is poured in a continuous manner into the moving mold portion of the casting apparatus formed by the band and the peripheral groove in the casting wheel as the casting wheel is rotated by an external drive mechanism. Coolant is applied to the external and/or internal surfaces of the wheel and to the outside surface of that portion of the band which closes the peripheral groove of the casting wheel, said coolant acting functionally to extract the heat from the molten metal at a rapid rate and to prevent the casting wheel and band from overheating. At the time the metal band is removed from the peripheral groove of the casting wheel by the band guide wheels the previously molten metal is sufficiently solidified to permit extraction from the casting wheel and be guided on to a succeeding stage in the continuous casting process.

In one such casting apparatus, using an 84" diameter wheel casting a 4 square inch bar section, the prior art band life extends typically to a range of 8 to 10 hours, or approximately one work shift.

A key component in the operation of such wheel-band molten metal casting apparatus is the band. Indeed, economics created by the wheel-band machines in the past which have reduced the cost of the manufactured rod/strip/wire product while increasing product quality are largely attributable to the inherent continuousness of operation of such machines. Once wheel life is maximized well beyond band life, band life becomes a factor most limiting the continuousness of operation of the casting machine. Extending band life therefore functions to reduce operating down time, maintenance time, and operating and maintenance costs. Other systemic advantages accompany extended band life, including longer component lifetimes for thermally cycled system parts (pour pots, launders, pour spouts, casting wheels, furnaces, and burners), more energy efficient casting, greater overall productivity, reduced scrap product, longer life of subsequent mill rolls (due to fewer start-ups), and a better quality product.

In the operation of wheel-band continuous casting systems of the type generally described above, one of the major problems is the care, maintenance, and replacement of the band. Due to the need to form the band into arcs to pass around the casting wheel and band guide wheels, it must be made of flexible materials. Additionally, thinner bands permit more efficient transfer of heat from the molten metal than thick bands while having two drawbacks; first, thin bands are more subject to band tensioning difficulties, and second, thin bands undergo more strenuous thermal cycling, compounding any tension difficulty tendencies. The two most common failure modes are due to thermal and machanical stresses; both effects must be carefully considered when selecting materials for casting bands. Other factors to be considered include band cost, cost of preparation, ease of installation, band life, safety, and heat extraction efficiency, the latter being of special import in the casting of alloys containing elements of differing solidification temperatures.

Generally, bands for this type of casting machine have been selected from among very low carbon steel alloys and copper and copper alloys when casting molten metals. One low carbon steel alloy in common use is A.I.S.I. 1006 or 1008 grade, having a good tensile strength (40,000 to 60,000 psi), low linear expansion, easily joined ends (TIG welding proves durable), is low in cost and in characterized by numerous other advantages when used for casting bands.

The selection of given band materials is, lastly, dependent on many other factors than life and wheel-compatible linear expansion factors. While the use of copper or copper alloy wheels is well known in the wheel-band continuous casting of copper, aluminum, steel, and other metals, the preferability of a band material with the characteristics of copper or copper alloys may be limited to the casting of only one or two metals or a few metal alloys. The accumulated experience in the art indicates that, for example, low carbon steel alloys are most suited to the widest range of metals and metal alloys, and is thus a more universal band material than copper or copper alloy bands. Low carbon steel bands have been found to be especially useful in the present invention.

Previous casting systems have incorporated pressurized air and heating or burner devices for drying the band and/or application of soot to the band surfaces. The present invention extends far beyond such devices in that such prior art devices did not increase band life while the present invention does so in a demonstratable manner, while also accomplishing the prior art object of band drying in a significantly improved manner. The previous band drying heaters were open, inefficient devices.

It is therefore obvious that there is a need in this art for certain improvements in operating economy such as may be obtained with greater operating lifetimes from inexpensive bands and, with increasing costs in the manufacture of metal casting machinery, reduced casting machine operating expense. Furthermore, a need exists for an improved, simplified band life extending apparatus intended for use with elongated bands, especially a band life extending apparatus which might at low cost be retrofitted to many prior art or previously manufactured casting machines.

SUMMARY OF THE INVENTION

Briefly described, the present invention comprises a casting machine generally known in the metal casting art as being of the wheel-band type including an improved band preheater device incorporating a burner, with which the operating life of a normal or greatly extended length band or ordinary low carbon steel may be greatly increased at minimal expense.

Thus it is an object of the present invention to provide an apparatus for extending casting band life.

Another object of this invention is the removal of any vestiges of coolant from the band surface before contacting molten metal in a succeeding casting cycle.

Yet another object of this invention is the reduction of casting machine downtime for replacement of a band or of a wheel by optimizing the band life.

Still another object of this invention is the avoidance of certain hazardous machine operation situations in the event of the band breaking.

Another object of this invention is the elimination of a separate band drying means.

With these and other objects in view which may become hereinafter apparent, the nature of the invention may be more clearly understood by reference to the several views illustrated in the accompanying drawings, the following detailed descriptions thereof, and the appended claims.

BRIEF DESCRIPTION OF DRAWINGS

Numerous other features and advantages of the invention disclosed herein will be apparent upon examination of the several drawing figures forming a part hereof, and in which like reference characters indicate corresponding parts in all views.

DISCLOSURE OF INVENTION

The present invention comprises a greatly improved band preheater which accomplishes the double purposes of ensuring a dry band and significantly extending band life. Energy savings are achieved by improved thermal efficiency.

These objects are achieved by incorporating a special band preheater along the band path after the cast metal is expelled from the casting path wherein the band preheater fully encloses the band and heat treats it for a portion of its travel through the casting cycle. Band life extensions of 50 to 100 percent are achievable.

The band preheater may be configured in innumerable arrangements, which for the purposes of this invention may be assumed to be equivalents provided such alternative configurations achieve substantially the same purposes in substantially the same way.

In brief, the primary configuration of the preferred embodiment of this invention is a ceramic fiber insulated box having heating means therein and provision for band entry and exit apertures. For convenience, the band should be made up remotely and changed on the machine as quickly and easily as possible.

BEST MODE FOR CARRYING OUT THE INVENTION

Figure 1:
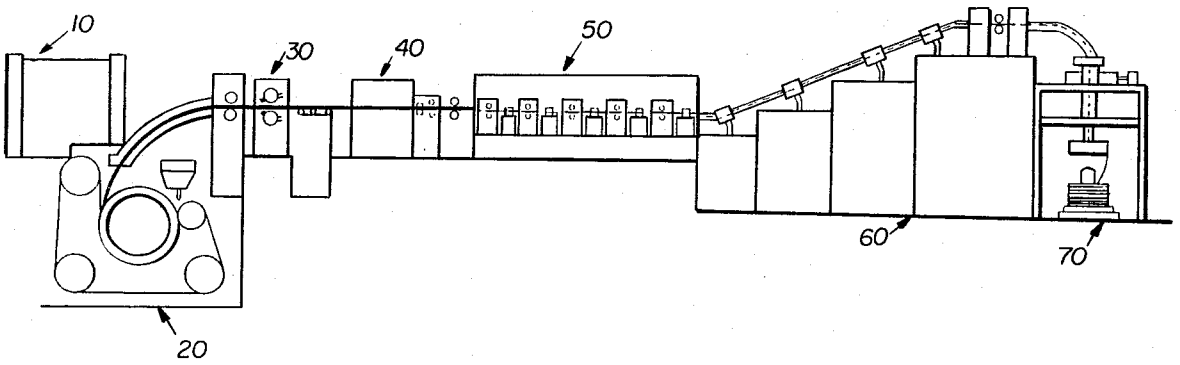
FIG. 1 PRIOR ART
FIG. 1 is a side elevation view of a typical wheel-band continuous casting apparatus incorporating the heating means of the present invention.

FIG. 1 illustrates a typical system for continuously casting and forming a molten metal. The molten metal to be cast is supplied by a melting or holding furnace 10 in which the metal's chemical composition and temperature are adjusted as necessary. The molten metal is then introduced in a continuous manner into the moving mold portion of the casting apparatus 20, which mold is commonly formed by a thin metallic band covering a portion of a peripheral groove in a rotatable casting wheel. Coolant is applied to the mold surfaces to functionally extract the heat from the molten metal at a rapid rate to both solidify the metal and to prevent the mold surfaces from overheating.

After solidification the cast metal bar is extracted from the casting apparatus 20 and typically guided through a shearing station 30, which may be used to sever sections of the cast bar as required during the initial starting up of the system, and through a bar preparation system 40 which may clean or condition the bar for rolling. A rolling mill 50 works the cast metal bar into rod by a plurality of roll stands which each reduce the bar's cross section while elongating it into wrought rod.

From the rolling mill 50 of the wrought rod is guided through a cleaning and/or colling section 60 and thence to a coiler station 70 where the finished rod is collected into coils for convenient handling, storage, or shipment.

Figure 2:
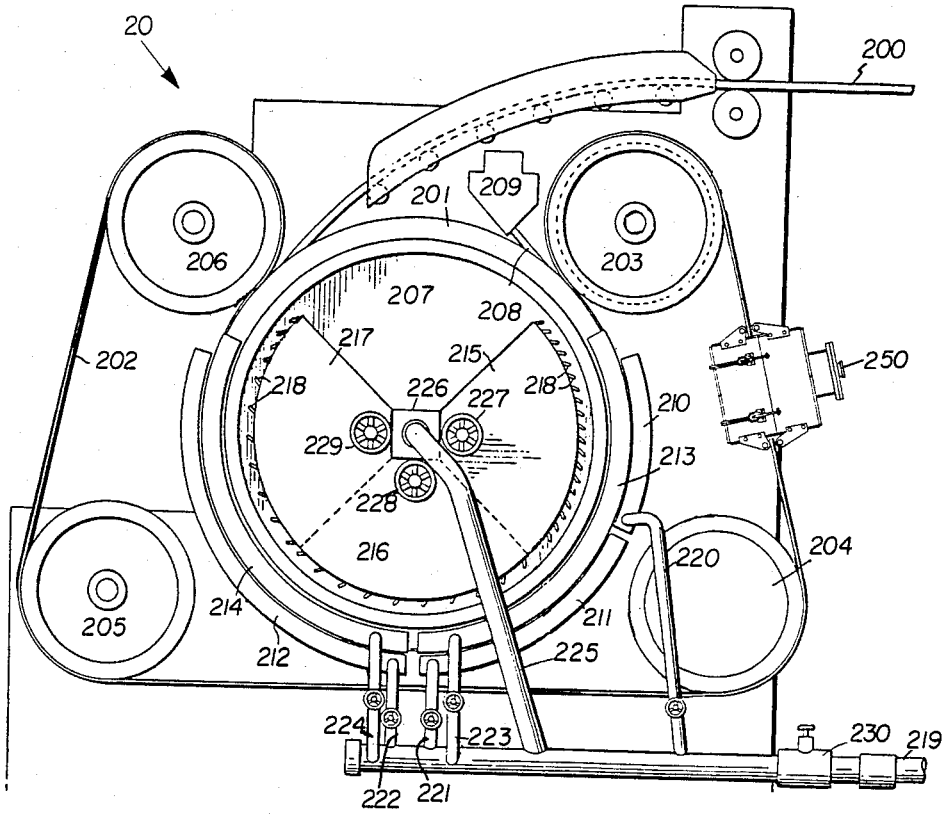
FIG. 2 is a side elevation view of the wheel-band casting machine of FIG. 1, including the invention.

Referring now in more detail to FIG. 2, one type of casting apparatus 20 for the continuous casting of metal is shown with some parts eliminated for clarity but which is generally well known in the art. Casting machine 20 includes a rotatable casting wheel 201, an endless flexible metallic band 202, and band positioning rollers 203, 204, 205, and 206 which position and guide the band 202 about a portion of the casting wheel 201.

The casting wheel 201 is removably affixed to rotatable support plate 207 which in turn is adapted to be driven by a variable-speed motor (not shown) so as to rotate the assembly in a clockwise direction. The casting wheel 201 has an outwardly facing annular peripheral groove which is closed by band 202 to form an arcuate mold cavity which extends about the lower portion of casting wheel 201.

The first band positioning roller 203, which is hereinafter called the presser wheel, functions to position or press the band 202 against the casting wheel 201 so as to tightly seal this portion of the peripheral groove which is to receive the molten metal.

The last band positioning roller 206, which is hereinafter called the tension wheel, is usually movable in a vertical direction and functions to tension band 202 against the lower portion of the casting wheel 201.

There are usually two or more other band positioning rollers 204 and 205 which are often called idler wheels and which function merely to guide the band 202 along its path from the tension wheel 206 back to the presser wheel 203.

During use, the band 202 frictionally engages the casting wheel 201 so that as casting wheel 201 is rotated by its support plate 207, the band 202 is urged along its path at the same speed. Thus a moving mold cavity is formed within the lower portion of the casting wheeel.

Molten metal is supplied to the moving mold cavity from a furnace 10 (FIG. 1) through a pouring pot 209 and pouring spout 208. The rate of flow of molten metal from the pouring spout 208 is regulated by suitable means so that the level of the molten metal pool in the mold remains just below the point at which the presser wheel 203 seals the band 202 against the peripheral groove in the casting wheel 201.

As casting wheel 201 is rotated, the molten metal is carried along its arcuate path within the moving mold where it is solidified by the cooling system and subsequently extracted as a cast bar 200 for further processing.

The cooling system comprises a multitude of liquid spraying nozzles 218 which direct a coolant, such as water, against the surfaces of the casting wheel 201 and the band 202 so as to extract heat therefrom, thus also extracting heat from the metal within the moving mold.

Some of the spray nozzles 218 communicate with casting wheel internal manifolds 215, 216, 217 while others communicate with band manifolds 210, 211, 212 and still others communicate with pairs of wheel side manifolds 213, 214.

Casting wheel manifolds 215, 216, 217 are positioned adjacent the rotatable support plate 207 and generally in the same plane as casting wheel 201. Each of the manifolds 215, 216, 217 extend through an arc of about 90° along the interior of casting wheel 201 starting near the presser wheel 203, thence along the lower portion of the casting wheel, and extending up towards the tension wheel 206. Manifolds 215, 216, 217 supply coolant to three successive groups, or zones, of spray nozzles 218.

Similarly, the band manifolds 210, 211, 212 are positioned along an arcuate path adjacent to the band 202 starting near the presser wheel 203 and extending in a downward direction around the lower portion of the casting wheel up to a point near the tension wheel 206.

A pair of wheel side manifolds 213 is positioned on opposite sides of the arcuate mold and extend from about the entrance of the mold down toward the bottom portion of the casting wheel 201 while another pair of side manifolds 214 extend from the bottom of the casting wheel 201 up towards the exit of the mold.

Thus it should be apparent that these various manifolds, each of which supply coolant to groups of spraying nozzles 218, allow the precise control of the cooling rate of the cast bar within the moving mold.

As shown in FIG. 2, the liquid coolant, such as water, is supplied to the manifolds of casting machine 20 by means of main supply pipe 219. A plurality of branch conduits extend from the main supply pipe 219 and communicate with the various manifolds as follows: conduit 220 supplies coolant to the upper band manifold 210, conduit 221 supplies coolant to the lower band manifold 211 and conduit 222 supplies coolant to the remaining rear band manifold 212. Branch conduit 223 supplies coolant to the front pair of side manifolds 213 while conduit 224 supplies coolant to the rear pair of side manifolds 214. Each of the aforementioned branch conduits includes a control valve which functions to regulate the flow of coolant from main supply pipe 219 to the various manifolds. Branch conduit 225 extends from the main supply pipe 219 and is connected to valve assembly 226 of the casting wheel manifolds 215, 216, 217. Valve assembly 226 includes three control valves 227, 228, 229 (preferably remotely actuated) which function to control the flow of coolant from branch conduit 225 into each of the interior wheel manifolds 215, 216, 217 respectively.

Preferably a main control valve 230 is positioned in main supply pipe 219 and may be electrically or pneumatically actuated so as to initiate the flow of coolant into the branch conduits when casting is begun.

In a typical casting machine such as has been described, having an 84" casting wheel and producing a 4 square inch bar section, average casting band life was extended from as little as 8 hours to as much as 15 hours, more typically between 10 and 15 hours when the present invention is installed and operating. In these cases the casting rate remained substantially constant at about 21 tons per hour.

Figure 3:
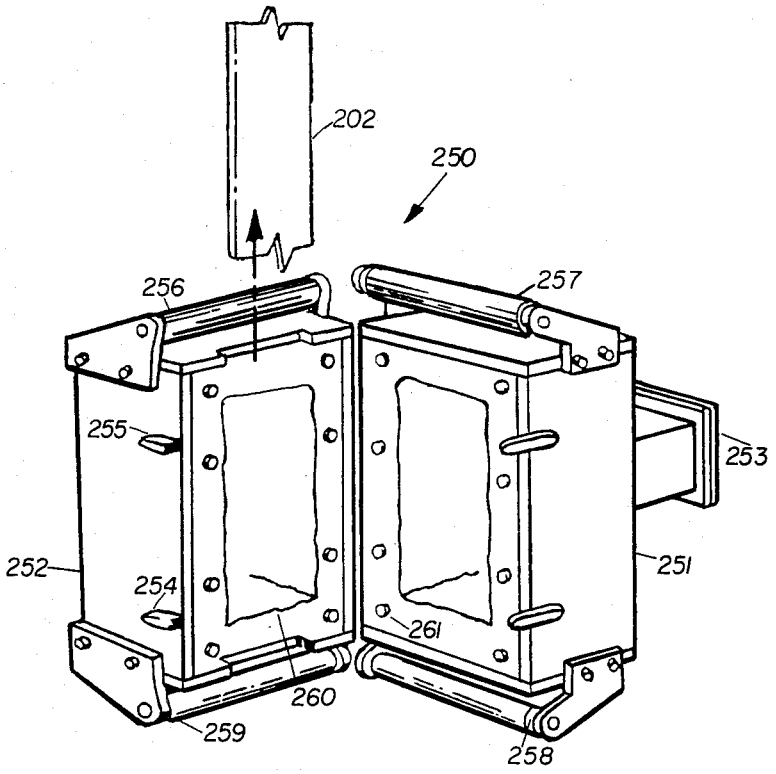
FIG. 3 is a view of a band heater opened for viewing.

In FIG. 3 the present invention comprises a small, gas-fired band heater 250 through which the band passes. It may be constructed, for example, but not limitation, of a box enclosure of two parts 251, 252 having a high-temperature heat source means such as a tunnel burner 253. FIG. 3 shows the band heater 250 in its open position, ready for inserting or removing the band 202, as for band change. Suitable closure fasteners are provided to maintain the enclosure closed, for example, but not limitation, a pair of toggle enclosure fasteners 254, 255 or the like. A plurality of guide rollers 256, 257, 258, 259 may be used, if desired, to guide the band 202 and protect the apparatus. The enclosure is lined with insulative material 260 for increased efficiency, retained in place in this example by retaining rods 261 of stainless steel or the like. The insulative material can be of any readily available suitable type; in this case "Kao-Wool" was used.

It is important to note that, aside from the band entry and exit apertures, no exhaust aperture is provided for the hot burner gases. These hot gases are intentionally exhausted out the band entry and exit apertures to direct this source of heat along both sides of the entering band and the exiting band, thereby greatly improving heating efficiency.

In one particular embodiment of the invention, the enclosure external dimensions are approximately 14 by 14 by 16 inches, with a 2-inch thick layer of "Kao-Wool" insulation. The band heating means 250 may be heated from a convenient nearby heat source or, for example but without limitation, a North American No. 2651-3B tunnel burner rated at 250,000 BTU/hr. at 4 inches water column pressure, using natural gas. The band should be heated to a temperature of at least 190° F., and preferably above 200° F. Experiments have shown that with a 0.1 inch thick by 6 inch wide band having an entering temperature of about 85° F. and travelling at approximately 44 lineal feet per minute, the band can be efficiently heated to about 210° F. with about 166,000 BTU/hr. and heated to about 245° F. with about 245,000 BTU/hr. at a slightly lower efficiency. The band 202 should remain in the band heater 250 for at least 1 second, and preferably for at least 1.65 seconds.

We claim:

1. In a continuous metal casting process of the type wherein molten metal is introduced into a continuously advancing mold cavity formed by at least one endless moving band surface in conjunction with other sealing surfaces, and wherein the molten metal is cooled to at least partial solidification, the improvement comprising extending band operating life by the additional steps of:

(a) enclosing a portion of the at least one endless moving band within an enclosure;

(b) passing the at least one endless moving band continuously through said enclosure; and (c) heating the band within the enclosure to a temperature of at least 190° F.

2. The process of claim 1, further characterized by the step of heating the band to a temperature of at least 210° F. within said enclosure.

3. The metal casting process of claim 1, wherein the band is heated by the exhausting of combustion gases through entry and exit apertures contained at opposite ends of said enclosure.

4. The metal casting process of claim 1, wherein the band is heated by the combustion of natural gas in said enclosure.

5. The process of claim 1 further characterized by the step of heating the band within an enclosure for a transit time within the enclosure of at least one second.

6. The process of claim 5 further characterized by the step of heating the band within an enclosure for a transit time within the enclosure of at least 1.65 seconds.

7. In an apparatus for continuous metal casting of the type including a continuously advancing mold, which mold is formed by at least one endless moving casting band surface of a moving band member in conjunction with other sealing surfaces for a portion of a predetermined path of travel of said band, the improvement comprising enclosure means having band entry and exit apertures for receiving the band, in combination with heat source means for producing heat and conveyance means adjacent said enclosure means for directing the heat to said enclosure means, in which the heat is concentrated within the enclosure for heating a portion of said band.

8. The apparatus of claim 7 in which the enclosure means includes band guide rollers disposed adjacent the band entry and exit apertures of the enclosure means.

9. The apparatus of claim 7 in which said heat source means is a carbonaceous fuel burner.

10. The apparatus of claim 7 in which the enclosure means is lined with high temperature insulation to retain heat therewithin.

11. The apparatus of claim 7, wherein the band is further heated by the combustion gases exiting from the band entry and exit apertures contained at opposite ends of said enclosure means.

12. The apparatus of claim 7 in which the enclosure means is formed of two partial box portions joined at the plane of the band entry and exit apertures.

13. The apparatus of claim 12, further comprising hinge means to enable separation of the two partial box portions of the enclosure means.

* * * * *